US005862787A

United States Patent [19]

Unuma et al.

[11] Patent Number: 5,862,787

[45] Date of Patent: Jan. 26, 1999

[54] RECOIL STARTER

[75] Inventors: Takaro Unuma; Isao Tsunakawa; Masayuki Murakami, all of Saitama-ken, Japan

[73] Assignee: Showakiki Industry Co., Ltd., Hiki-gun, Japan

[21] Appl. No.: 685,485

[22] Filed: Jul. 24, 1996

[30] Foreign Application Priority Data

Aug. 4, 1995 [JP] Japan ..... 7-218340
Apr. 16, 1996 [JP] Japan ..... 8-094470

[51] Int. Cl.[6] ..... F02N 3/02

[52] U.S. Cl. ..... 123/185.3

[58] Field of Search ..... 123/185.2, 185.3, 123/185.4; 74/7 C; 192/42

[56] References Cited

U.S. PATENT DOCUMENTS 2,460,420 2/1949 Kincannon ..... 123/185.3
3,754,543 8/1973 Harkness ..... 123/185.3
4,480,605 11/1984 Bloemers ..... 123/185.3
4,637,360 1/1987 Osakabe ..... 123/185.3

FOREIGN PATENT DOCUMENTS 50-743 1/1975 Japan .

*Primary Examiner*—Andrew M. Dolinar
*Attorney, Agent, or Firm*—Wenderoth, Lind & Ponack, L.L.P.

[57] ABSTRACT

A recoil starter comprises a reel 7 rotatably supported by a case 2, a slant first cam 14 disposed on the reel 7 and facing an engine side, and a dog 20 rotatably and axially movably supported on an axis coaxial with the reel 7. The dog 20 is provided with an engagement claw 26 engageable with an engagement portion 28 on the engine side, and a first cam follower 23 engageable with the first cam 14. The recoil starter further comprises a retainer 31 mounted on the case 3, the retainer 31 being engageable with the dog 20 and capable of braking rotation of the dog 20. The recoil starter further comprises a projection 15 projecting from the reel 7 and engageable with the dog 20 when the reel 7 starts rotation. The reel 7 is provided with a slant cam 18 facing away from the engine side. The dog 20 is provided with a second cam follower 24 engageable with the second cam 18.

5 Claims, 27 Drawing Sheets

RECOIL STARTER

FIELD OF THE INVENTION

This invention relates to a recoil starter, in which a smooth starting operation is always ensured and its service life is not adversely affected by aging as a result of long-time use, even under critical circumstances, the manufacturing cost can be lowered by reducing the number of component parts, and in addition, versatile requirements for the construction can be amicably met.

DESCRIPTION OF THE PRIOR ART

In one typical construction of a recoil starter, for starting an engine, a rope is tensioned to rotate a reel and a dog is caused to move in the axial direction so that the reel will engage a flywheel.

For example, a recoil starter disclosed in Japanese Utility Model Publication No. 19588/1990 has a pair of slant surfaces projecting from the surface of a reel, and a driving plate axially movable through a braking force of a brake plate. The driving plate is always ready to engage the slant surfaces.

Specifically, the driving plate is provided with a plurality of clutch teeth. When the engine is to be started, the driving plate is moved in the axial direction and the clutch teeth are brought into engagement with corresponding clutch teeth of a flywheel.

However, the conventional recoil starter of this type has shortcomings in that since there is a requirement of a provision of a retainer spring for causing the driving plate to engage normally with the slant surfaces of the reel, the number of component parts is increased to that extent, thus creating a cause for an increase in manufacturing cost, and in that a smooth starting operation is adversely affected by long-time use under critical circumstances, thus reducing the service life of the recoil starter.

More specifically, the retainer spring has the role of preventing the driving plate from moving towards the engine side. Therefore the retainer spring is required to maintain a good balance among a force for pressing the driving plate against the slant surfaces of the reel, a braking force of the brake plate and a return force of the rope.

For example, if the resiliency of the retainer spring is too large, the driving plate tends to rotate in unison with the brake plate when the rope is tensioned, and therefore, no relative rotation occurs between the driving plate and the brake plate. The result is that the driving plate fails to move towards the engine side.

To avoid this, if the braking force of the brake plate is increased, the return force of the rope is reduced because the braking force offsets the return force of the rope.

On the other hand, if the resiliency of the retainer spring is too small, it sometimes happens that when the rope is released, the retainer spring cannot support the dead weight of the driving plate, and therefore the driving plate cannot normally engage the slant surfaces of the reel, thus making it impossible for the driving plate to move towards the reel side. This occurs in a case where the engine is installed in a lower position depending on the state of installation of the recoil starter.

The above-mentioned good balance can be achieved by the retainer spring, but only at the early stage of use of the recoil starter. However, with the passage of time, the retainer spring is subjected to fatigue. As a consequence, the above-mentioned unfavorable situation occurs, as experienced when the resiliency of the spring is too small.

If the recoil starter should be used in such critical circumstances as where a lot of sand and dust exist, the sand and dust would enter the normal, engaging area between the driving plate and the slant surfaces of the reel, thus causing a gouge or chafing. This makes it difficult for the driving plate to move smoothly in the axial direction. As a consequence, a smooth starting operation becomes difficult to obtain and the service life is adversely affected.

SUMMARY OF THE INVENTION

It is, therefore, an object of the present invention to provide a recoil starter in which the above-mentioned shortcomings can be eliminated and a smooth starting operation can be maintained in spite of long-time use, even under critical circumstances.

Another object of the present invention is to provide a recoil starter in which degradation of the service life can be prevented.

A further object of the present invention is to provide a recoil starter in which the number of component parts can be reduced and the manufacturing cost can be lowered.

A still further object of the present invention is to provide a recoil starter in which versatile requirements for the structure can be met.

To achieve the above objects, a recoil starter according to the present invention comprises a reel rotatably supported by a case. A slant first cam is disposed on the reel and faces an engine side. A dog is rotatably and axially movably supported on an axis coaxial with the reel, the dog being provided with an engagement claw engageable with an engagement portion on the engine side. A first cam follower is engageable with the first cam. A retainer is mounted on the case, the retainer being engageable with the dog and capable of braking rotation of the dog. A projection projects from the reel and is engageable with the dog when the reel starts rotation.

A slant second cam is disposed on the reel and faces an anti-engine side, and the dog is provided with a second cam follower engageable with the second cam.

With the recoil starter thus constructed, a smooth starting operation can be maintained in spite of long-time use even under critical circumstances, the number of component parts can be reduced, and the manufacturing cost can be lowered.

The above objects, features and advantages of the present invention will become more manifest upon a reading of the following detailed description with reference to the accompanying drawings.

DETAILED DESCRIPTION OF THE PREFERRED EMBODIMENTS

Figure 1:
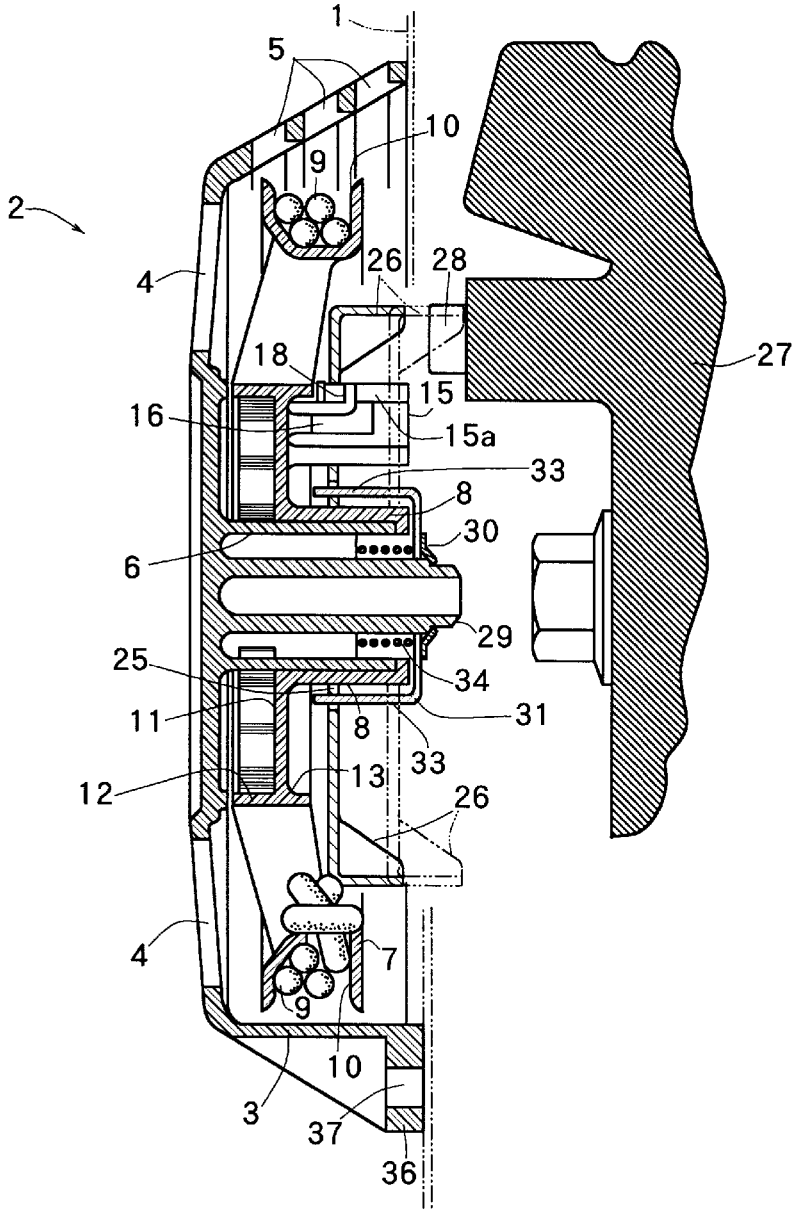
FIG. 1 is a sectional view showing a first embodiment of the present invention.
Figure 4:
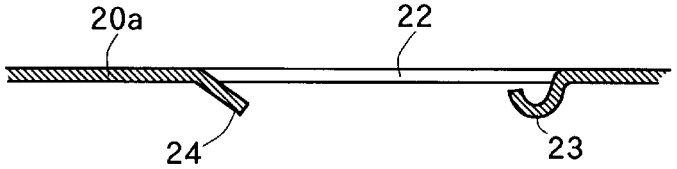
FIG. 4 is an enlarged sectional view taken on line IV—IV of FIG. 3.

Several embodiments of the present invention will now be described with reference to the accompanying drawings. In FIGS. 1 through 13, reference numeral 1 denotes a cover arranged on an external side of an engine (not shown). A case 3 of a recoil starter is attached to the surface of the cover 1.

The case 3 is made of synthetic resin and has a generally dish-like configuration in section. A plurality of air inlet ports 4 and 5 are formed respectively in a bottom surface and a side surface of the case 3. A hollow sleeve-like center shaft 6 projects from an inner side of the bottom surface.

A reel 7 made of synthetic resin is rotatably supported on an outer peripheral surface of the center shaft 6 through a pipe collar 8. A rope groove 10, on which ropes 9 can be wound, is formed in a side peripheral surface of the reel 7. A concave spring chamber 11 is formed in a side surface of the reel 7 corresponding to the bottom surface of the case 3, and a wind-up type recoil spring 12 is received in the chamber 11.

One end of the recoil spring 12 is hooked on a basal portion of the center shaft 6 and the other end is hooked on a peripheral surface of the spring chamber 11. The reel 7 is biased by the resilience of the recoil spring 12 so that the reel 7 can rotate in the taking-up direction of the rope 9.

A circular recess 13 is formed in a peripheral surface of a basal portion of the pipe collar 8. Rib-like first cams 14, 14 project from symmetrical locations of an outer peripheral surface of the recess 13.

Figure 5:
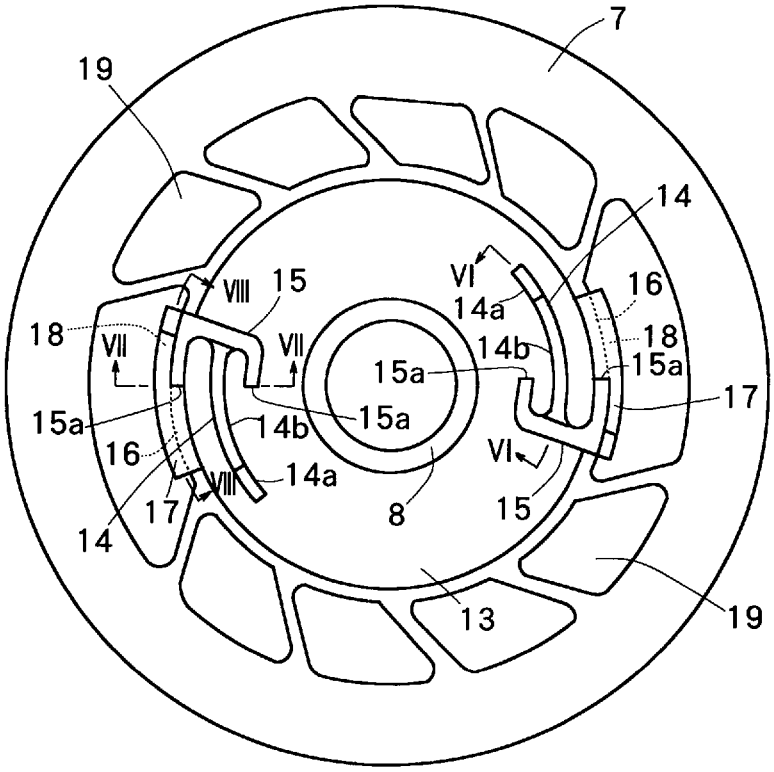
FIG. 5 is a plan view showing a reel applied to the present invention.
Figure 6:
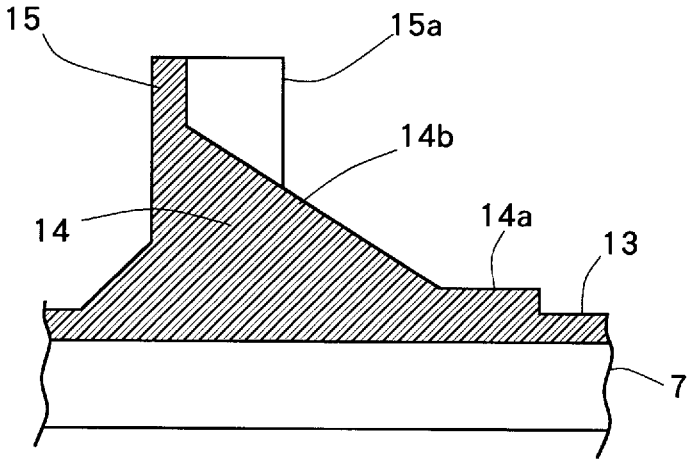
FIG. 6 is an enlarged sectional view taken on line VI—VI of FIG. 5.

The first cam 14 has, as shown in FIG. 5, a configuration concentric with the reel 7 in a plan view. A developed shape of the first cam 4 is, as shown in FIG. 6, generally tapered so that its height is gradually reduced in a normally rotating direction (as indicated by an arrow of FIG. 2) of the reel 7. On their upper surfaces, namely, on end faces on the engine side, cam faces 14*a* and 14*b* are defined.

Of the cam faces, the cam face 14*a*, as shown in FIG. 6, has a small height and parallel with the surface of the recess 13. The other cam face 14*b* is continuous with a terminal portion of the cam face 14*a*.

The cam face 14*b* is tapered such that its height is gradually reduced in the normally rotating direction of the reel 7. A projection 15 having a U-shape in a plan view is connected to a terminal portion of the cam face 14*b* and engageable with a dog as later described.

The projections 15, 15 project from symmetrical locations of an outer peripheral portion of the recess 13. An upper end portion (i.e., that end portion on the engine side) of each projection 15 is higher than the terminal portion of the cam face 14*b*.

Upstanding walls 16, 16 are formed along an outer end portion of the recess 13 in a radially outward direction of the first cams 14, 14. Each wall 16 is tapered such that its height is gradually reduced in the normally rotating direction of the reel 7. A tapered guide plate 17 projects radially outwardly from an upper end portion of the wall 16.

One end of the upstanding wall 16 and the guide plate 17 is connected to the projection 15. A second cam 18 is disposed on a lower surface (i.e., that surface opposite to the side of the engine) of the plate 17.

Figure 7:
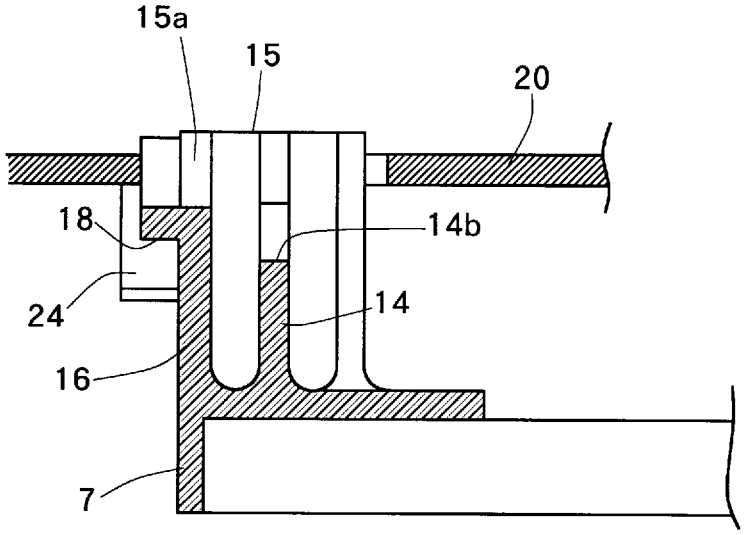
FIG. 7 is an enlarged sectional view taken on line VII—VII of FIG. 5.
Figure 8:
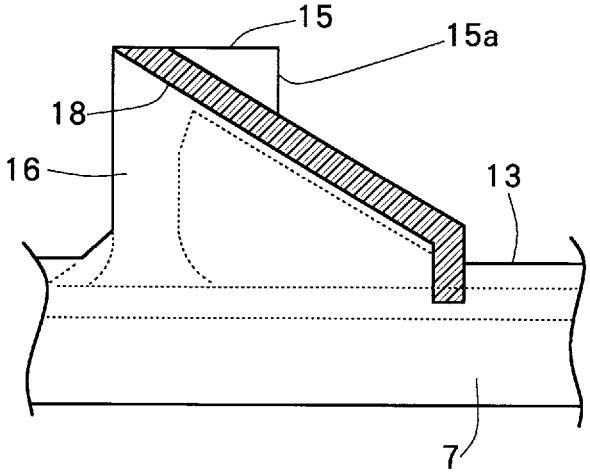
FIG. 8 is an enlarged sectional view taken on line VIII—VIII of FIG. 5.

A cam face of the second cam 18 is horizontal as shown in FIG. 7. The cam 18 has an arcuate configuration concentric with the first cam 14 in a plane. As shown in FIG. 8, the cam 18 is similarly tapered in its developed shape as the first cam 14.

In the illustrations, reference numeral 19 denotes a plurality of ventilating holes formed in the reel 7.

Figure 3:
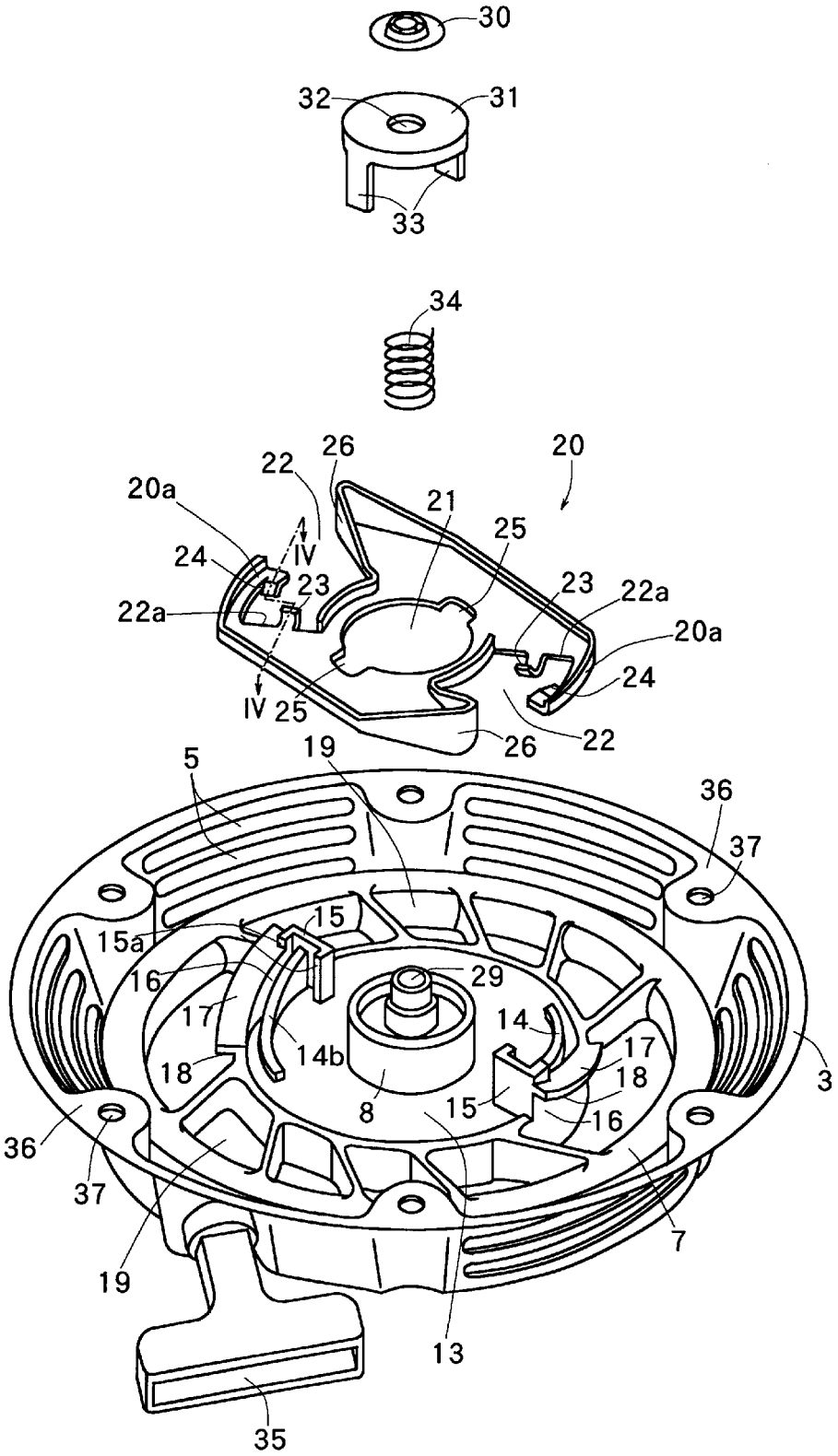
FIG. 3 is an exploded perspective view showing a main part of the present invention.

A dog 20 made of steel is arranged in an adjacent location to the reel 7. As shown in FIG. 3, the dog 20 has a flat dish-like configuration. A through-hole 21 is formed in the center of the dog 20. The pipe collar 8 can be inserted into the through-hole 21.

Engagement holes 22, 22 each having a generally ground paper like configuration are formed in opposite sides of the through-hole 21. Engaging edges 22*a*, 22*a* extending radially of the holes 22, 22 are engageable with engaging surfaces 15*a*, 15*a* of the projections 15, 15, respectively. Outer end portions of the engagement holes 22, 22 are opened at the outer peripheral portion of the dog 20.

At intermediate locations of the engaging edges 22*a*, 22*a*, first cam followers 23, 23 are folded in a generally U-shape towards the opposite side of the engine, with the distal end portions of the first cam followers 23, 23 allowed to project towards the anti-engine side from the side surface of the dog 20. The cam followers 23, 23 can slidingly move on the cam faces 14*a*, 14*b* of the first cam 14.

Dog arms 20*a*, 20*a* project from outer end portions of the engaging edges 22*a*, 22*a* in the backwardly rotating direction of the reel 7. Second cam followers 24, 24 are disposed at radially inner sides of distal end portions of the arms 20*a*, 20*a*. In this case, the number of the dog arms 20*a* and second cam followers 24 is not limited to one pair as in the embodiment, and it may be one, or two or more.

Each second cam follower 24 is bent in a slant posture towards the opposite side of the first cam follower 23, namely, towards the anti-engine side, and is engageable with the second cam 18.

Instead of bending the second cam follower 24 in the slant posture, it may merely be bent towards the anti-engine side. By doing this, the structure and manufacture of the second cam follower 24 become simple.

A pair of guide portions 25, 25 are arranged in the radial direction of the through-hole 21 and face each other. A leg of a retainer as later described can be slidingly inserted into the guide portion 25.

Engagement claws 26, 26, each having a V-shaped configuration in plan view, are formed with upstanding postures on external opening edge portions of the engagement holes 22, 22. Each engagement claw 26 is engageable with an engaging portion 28 of a flywheel 27.

In the illustrations, reference numeral 29 denotes a support shaft projecting from the center of the bottom surface of the case 3. This shaft 29 is disposed at an internal side of the center shaft 6. A retainer 31 is attached to a distal end of the shaft 29 through a stop ring 30.

The retainer 31 has a generally dish-like configuration. A through-hole 32 is formed in the center of the retainer 31. The distal end portion of the support shaft 29 can be inserted into the through-hole 32. A pair of legs 33, 33 project from an outer peripheral portion of the through-hole 32 in opposing relation.

A brake spring 34 is interposed between the retainer 31 and an interior of the distal end of the center shaft 6. Rotation of the dog 20 can be braked by the resiliency of the brake spring 34.

Reference numeral 35 denotes a handle hooked on an outer end portion of the rope 10, and 36, a plurality of attachment portions formed on a peripheral surface of the end portion of the case 3, respectively. A machine screw hole 37 is formed in a planar surface of each attachment portion 36.

Operation of the recoil starter thus constructed will now be described.

The dog 20, braked by the retainer 31 as later described, is moved in the axial direction by means of engagement between the first cam follower 23 and the first cam 14, and as a consequence, the second cam follower 24 can engage the second cam 18.

Consequently, the provision of the conventional retainer spring is no longer required, and therefore, the number of component parts is reduced to that extent. Since the time and labor for attaching the retainer spring are no longer required, the manufacturing cost can be lowered.

One state of such an attachment is shown in FIG. 1. As illustrated, the pipe collar 8 is inserted in the through-hole 21 of the dog 20, and the legs 33, 33 of the retainer 31 are inserted into the guide portions 25, 25, respectively, so that the retainer 31 is hooked on the distal end of the center shaft 6 through the stop ring 30.

Accordingly, the dog 20 can move in the axial direction along the legs 33, 33. Before the starting operation of the engine, the dog 20 is located on the reel 7 side. Depending on the state of installation of the recoil starter 1 (for example, installation in a horizontal state as in this embodiment), the first cam follower 23 is proximate to or contacts the cam face 14*a* as shown in FIG. 9.

Figure 2:
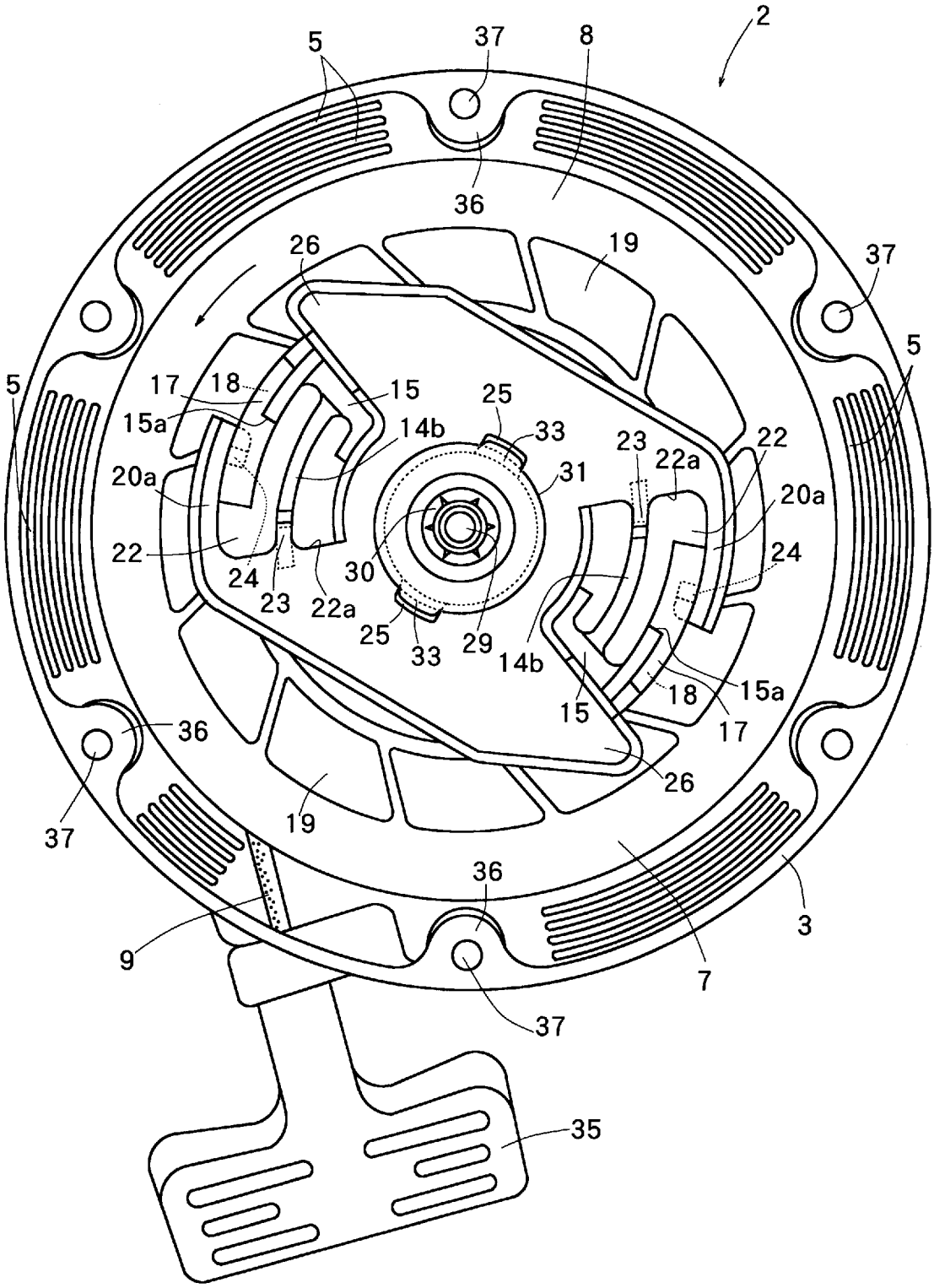
FIG. 2 is a plan view showing the first embodiment of the present invention.

As shown in FIG. 2, the first cam follower 23 is located at a moving area of the first cam 14, and the retainer 31 is pressed against the stop ring 30 by resiliency of the brake spring 34, so that its rotation is suppressed by the contact surface pressure or frictional force.

Figure 9:
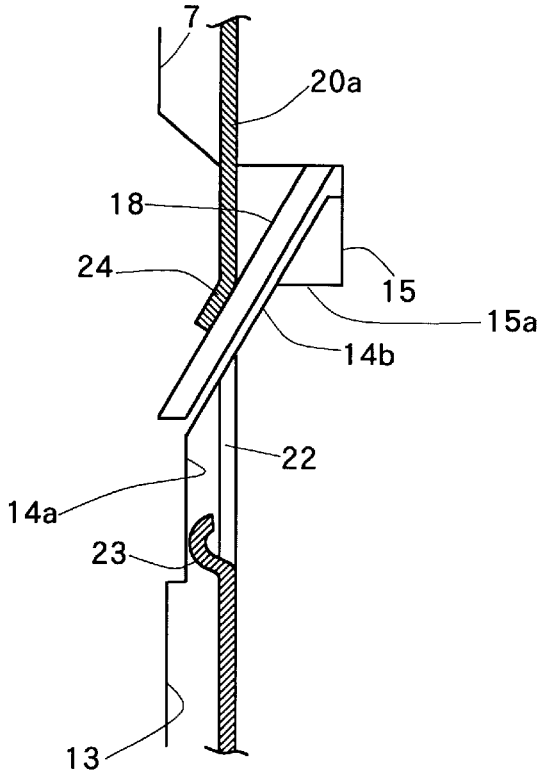
FIG. 9 is an explanatory view showing an operating state of the present invention, before starting operation.
Figure 10:
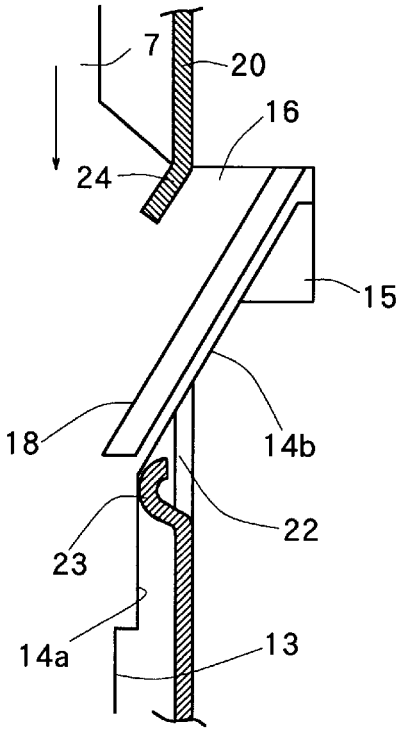
FIG. 10 is an explanatory view showing an operating state of the present invention in which the reel is in its normally rotating state immediately after starting operation.

Further, as shown in FIGS. 7 and 9, the second cam follower 24 engages the second cam 18, so that rotation or swinging of the dog 20 is prevented.

When the handle 35 is pulled under such a situation as just mentioned, the reel 7 is rotated in a normal direction as indicated by an arrow of FIG. 2, and the projection 15 moves in unison with the reel 7. As a consequence, the second cam 18 is brought away from the second cam follower 24.

Figure 11:
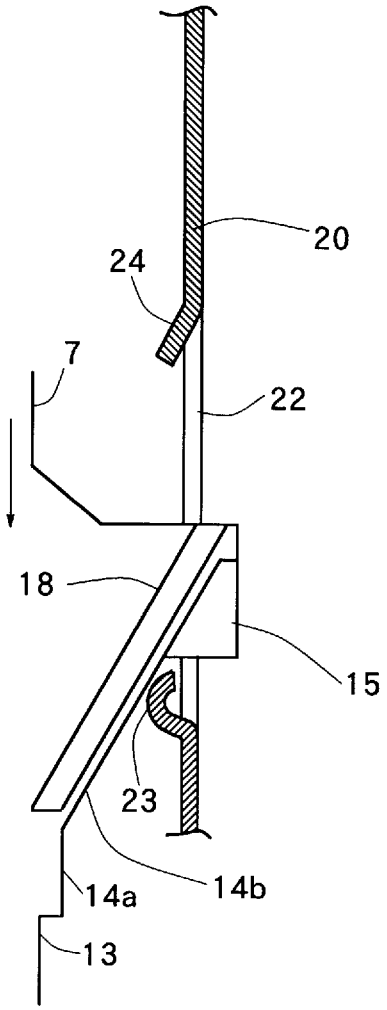
FIG. 11 is an explanatory view showing an operating state of the present invention in which the reel is in its normally operating state at an intermediate stage of starting operation.
Figure 12:
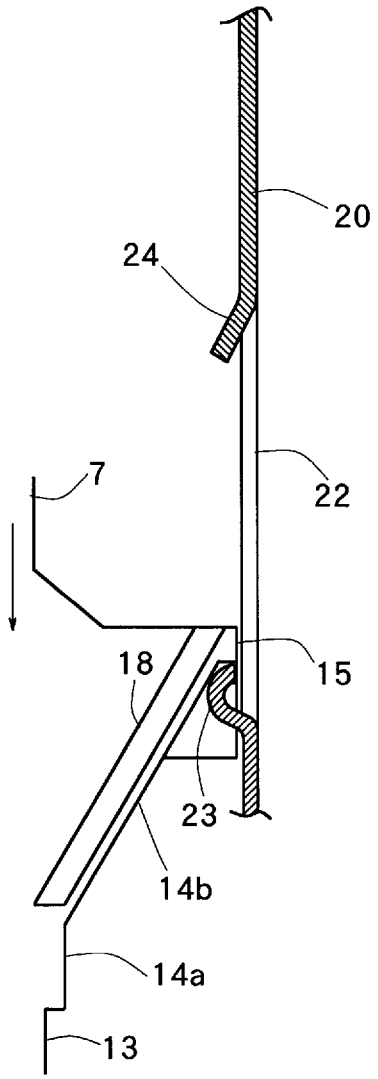
FIG. 12 is an explanatory view showing an operating state of the present invention in which the reel is in its normally rotating state at a final stage of starting operation.

Thereafter, the first cam follower 23 moves from the cam face 14*a* to the cam face 14*b*. As shown in FIG. 11, the first cam follower 23 slidingly moves on the cam face 14*b*, whereas the dog 20 moves towards the engine side along the leg 33 of the retainer 31.

When the first cam follower 23 moves to that end portion of the cam face 14*b* on the engine side, that is, when the dog 20 moves closest to the engine side and the engaging edges 22*a* are brought into abutment with the engagement surface 15*a* of the projection 15, the dog 20 starts rotation in unison with the reel 7.

Thereafter, the speed of rotation of the dog 20 is increased, the engagement claw 26 is brought into engagement with the engaging portions 28 of the flywheel 27, and the rotational force of the dog 20 is transmitted to the flywheel 27. As a consequence, the flywheel 27 is rotated, and therefore, the engine associated with the flywheel 27 starts operation.

In this way, when the engine starts operation, the speed of rotation of the engaging portion 28 becomes higher than that of the engagement claw 26 and a speed difference occurs therebetween. This enhances the disengagement of the engagement claw 26 from the engaging portion 28.

When the speed of rotation of the flywheel 27 is further increased and the engagement claw 26 is brought into abutment with the engaging portion 28, the backward rotation of the dog 20 is enhanced and the second cam follower 24 is brought into engagement with the second cam 18 of the reel 7. As a consequence, the dog 20 is forcibly moved towards the reel 7 side.

About that time, when the hand is removed from the handle 35 after starting operation of the engine, the reel 7 is rotated backwardly by resilience of the recoil spring 12 and the rope 9 is taken up into case 3 so as to be wound on the rope groove 10.

Figure 13:
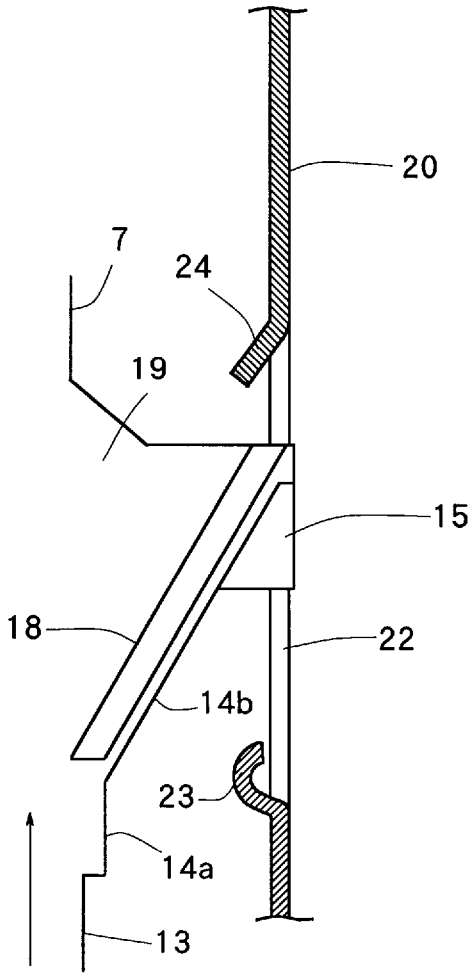
FIG. 13 is an explanatory view showing an operating state of the present invention in which the reel is in a backwardly rotating state immediately after starting operation.

On the other hand, the projection 15 is brought away from the first cam follower 23, the second cam 18 is brought closer to the second cam follower 24 and engaged with the second cam follower 24 as shown in FIG. 13, and the dog 20 is urged to return to its original position under the effect of an engaging component of force towards the reel 7 side by the second cam 18.

Thereafter, the reel 7 is further rotated backwardly, the second cam 18 is brought into more intimate engagement with the second cam follower 24, and the dog 20 is moved towards the reel 7 side until it is returned to its original position. Then, the reel 7 is stopped and held still.

In this way, according to the present invention, when the rope 9 is required to be pulled out, the first cam 14 is brought into engagement with the first cam follower 23 to move the dog 20 towards the engine side. When the rope 9 is required to be pulled back, the second cam 18 is brought into engagement with the second cam follower 24 to move the dog 20 smoothly towards the reel 7 side.

FIGS. 14 through 45 show other embodiments of the present invention, in which component parts corresponding to those of the above-mentioned embodiment are denoted by identical reference numerals.

Of those illustrations, in a second embodiment shown in FIGS. 14 through 25, the first cam 14 is located more radially outwardly than the above-mentioned embodiment, the first cam 14 and the second cam 18 are arranged adjacent to each other in the radial direction in a plane, and the engagement claw 26 is located proximate to and right under the first cam follower 23.

That is, the engagement claw 26 is located on a side surface of the dog 20 on the opposite side of the first cam follower 23 and corresponding to the first cam follower 23, so that an impact, which the engagement claw 26 would otherwise receive at the time of starting operation, is received by the first cam 14 through the proximal first cam follower 23. As a consequence, the dog 20 can be supported in a stable manner and prevented from being deformed and/or broken.

Further, the engagement claw 26 projects towards the engine side and faces the engaging edge 22*a*, so that an impact, which would otherwise be received by the engagement claw 26 when the engagement claw 26 engages the engaging portion 28, is received by the projection 15 through the engaging edge 22*a*. As a consequence, the dog 20 can be supported in a stable manner and prevented from being deformed and/or broken.

In this embodiment, the upstanding wall 16 extends upwardly to form the first cam 14 and the cam 14 is arranged adjacent to the guide plate 17 in its radial direction, so that the cam 14 is arranged adjacent to the second cam 18, which is located on a back surface of the plate 17, in its radial direction in a plane.

In the illustrations, reference numeral 38 denotes a chevron-like support wall projecting from one side of the projection 15. The support wall 38 is arranged in a concentric circle with the first cam 14 or upstanding wall 16. A generally serrated engagement projection 39 projects from an area between the wall 38 and the first cam 14. Owing to this arrangement, when the rope 9 is loosened, the dog 20 can be prevented from axially abutting against the reel 7 and the dog arms 20*a*, 20*a* can be prevented from being broken.

The dog 20 is made of synthetic resin and has a deformed plate-like configuration. Engagement claws 26, 26 project from the dog 20 and face the engaging edges 22*a*, 22*a* of the engagement holes 22, 22, respectively.

The engagement claw 26 has a generally chevron-like configuration as illustrated. A tapered surface 26*a* is formed on that side of the engagement claw 26 which abuts with the engagement surface 15*a*, so that when the engagement claw 26 abuts with the engaging portion 28 after starting operation of the engine, the reel 7 is enhanced to return to its original position.

Figure 24:
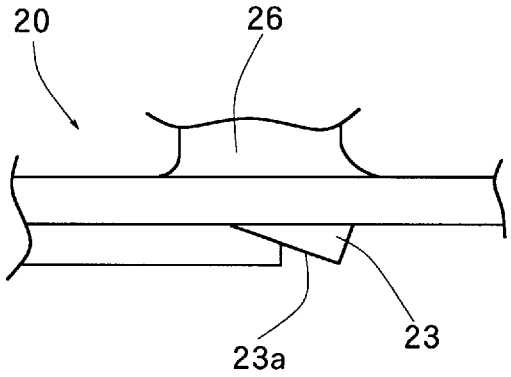
FIG. 24 is a side view showing a second cam follower which is applied to the second embodiment.

On the anti-engine side surface of the dog 20, which is right above the engagement claw 26, the first cam follower 23 projects toward the anti-engine side from the side surface of the dog 20. As shown in FIG. 24, the follower 23 has a generally chevron-like configuration, and its tapered surface 23*a* can engage the first cam 14 and slidingly move thereon.

In the illustrations, reference numeral 40 denotes a long hole formed in a symmetrical location on the external side of the through-hole 21. The leg 33 of the retainer 31 is inserted into the hole 40. Reference numeral 41 denotes a cut-out formed in a lower end of the leg 33, and 42, a protrusion protruding from the peripheral surface of the dog 20 and engageable with the engagement projection 39.

Figure 14:
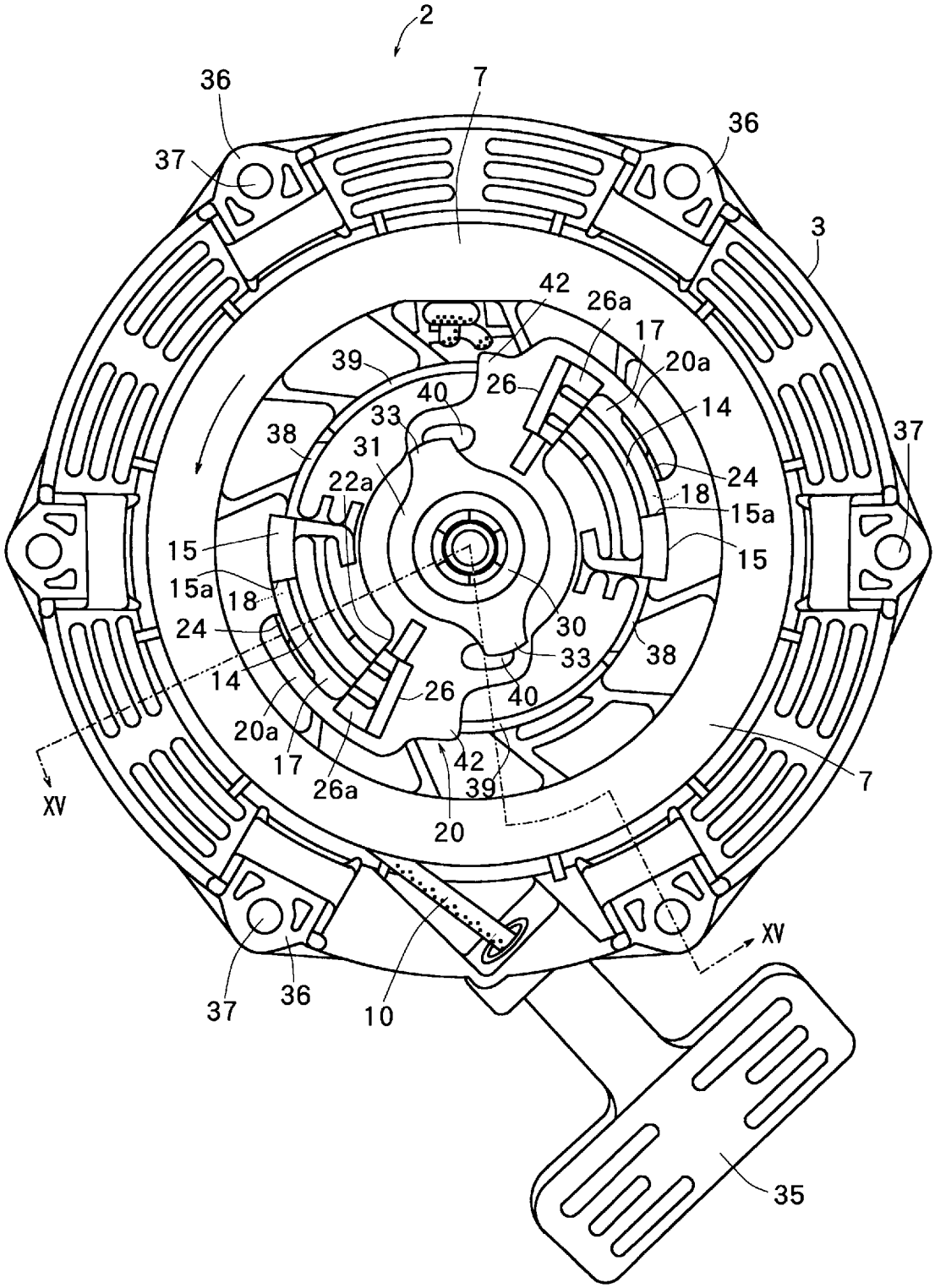
FIG. 14 is a plan view showing a second embodiment of the present invention.
Figure 23:
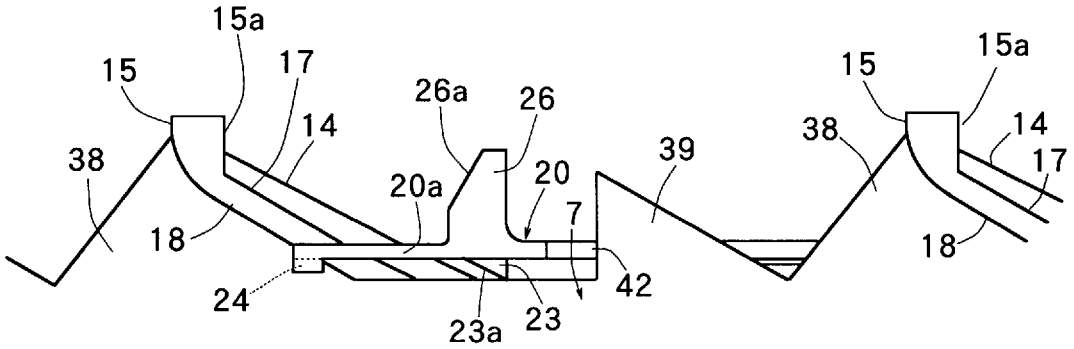
FIG. 23 is an explanatory view showing an operating state of the second embodiment before starting operation.

In the recoil starter according to this embodiment, the dog 20, as shown in FIGS. 14 and 23, is located on the reel 7 side before starting operation, and the protrusion 42 is abutted with the engagement projection 39 and held still, so that when the rope 9 is loosened, the dog 20 is prevented from axially abutting with the reel 7 and the dog arms 20*a*, 20*a* are prevented from being broken.

At that time, the first cam follower 23 is in a location engageable with the lowermost position of the first cam 14, whereas the second cam follower 24 is in an intermediate position of the second cam 18. In that state, when the handle 35 is pulled, the reel 7 is rotated normally in the direction as indicated by an arrow of FIG. 14 and the dog is moved in unison with the reel 7. As a consequence, the leg 33 of the retainer 31 is engaged with the long hole 40 and therefore, the dog 20 stops rotation.

When the reel 7 rotates further in the same direction, the first cam 14 crawls into a location under the first cam follower 23 from its bottom side. In other words, the first cam follower 23 slidingly moves on the first cam 14 towards the engine side.

Figure 15:
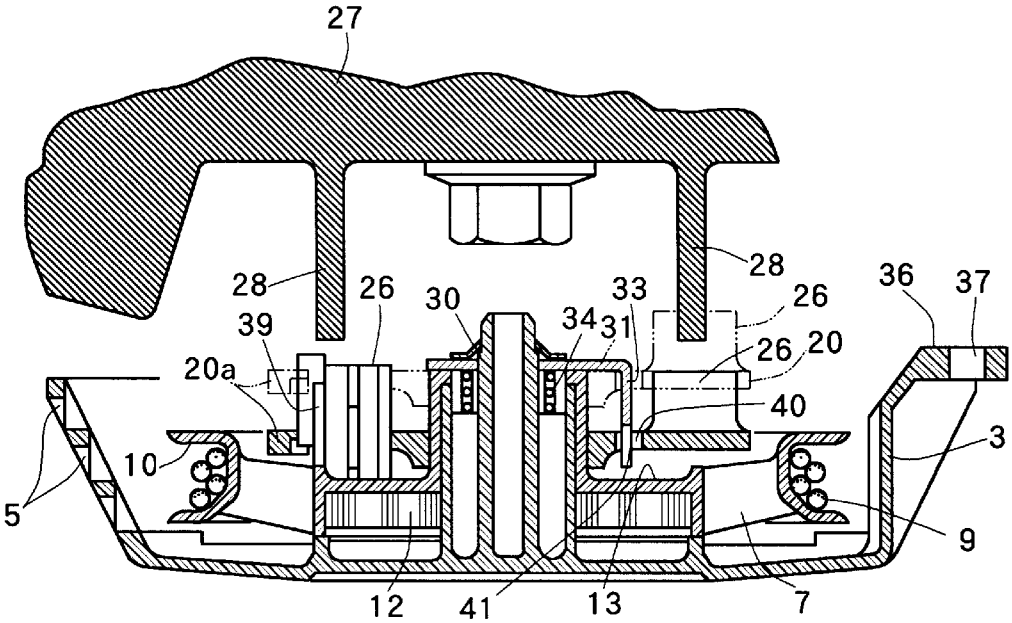
FIG. 15 is a sectional view taken on line XV—XV and shown on a somewhat reduced scale.
Figure 17:
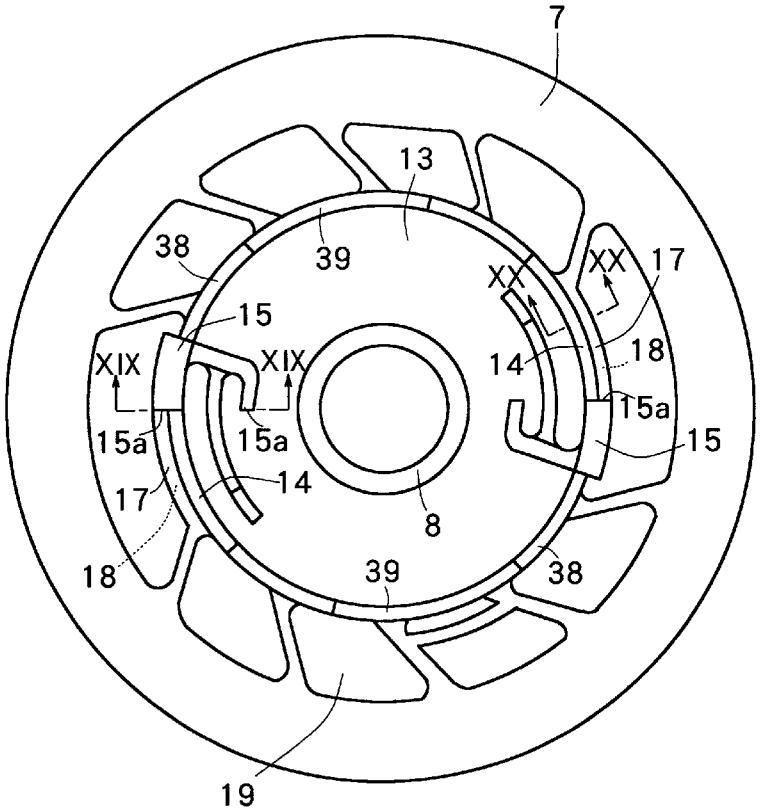
FIG. 17 is a plan view showing a reel which is applied to the second embodiment.
Figure 16:
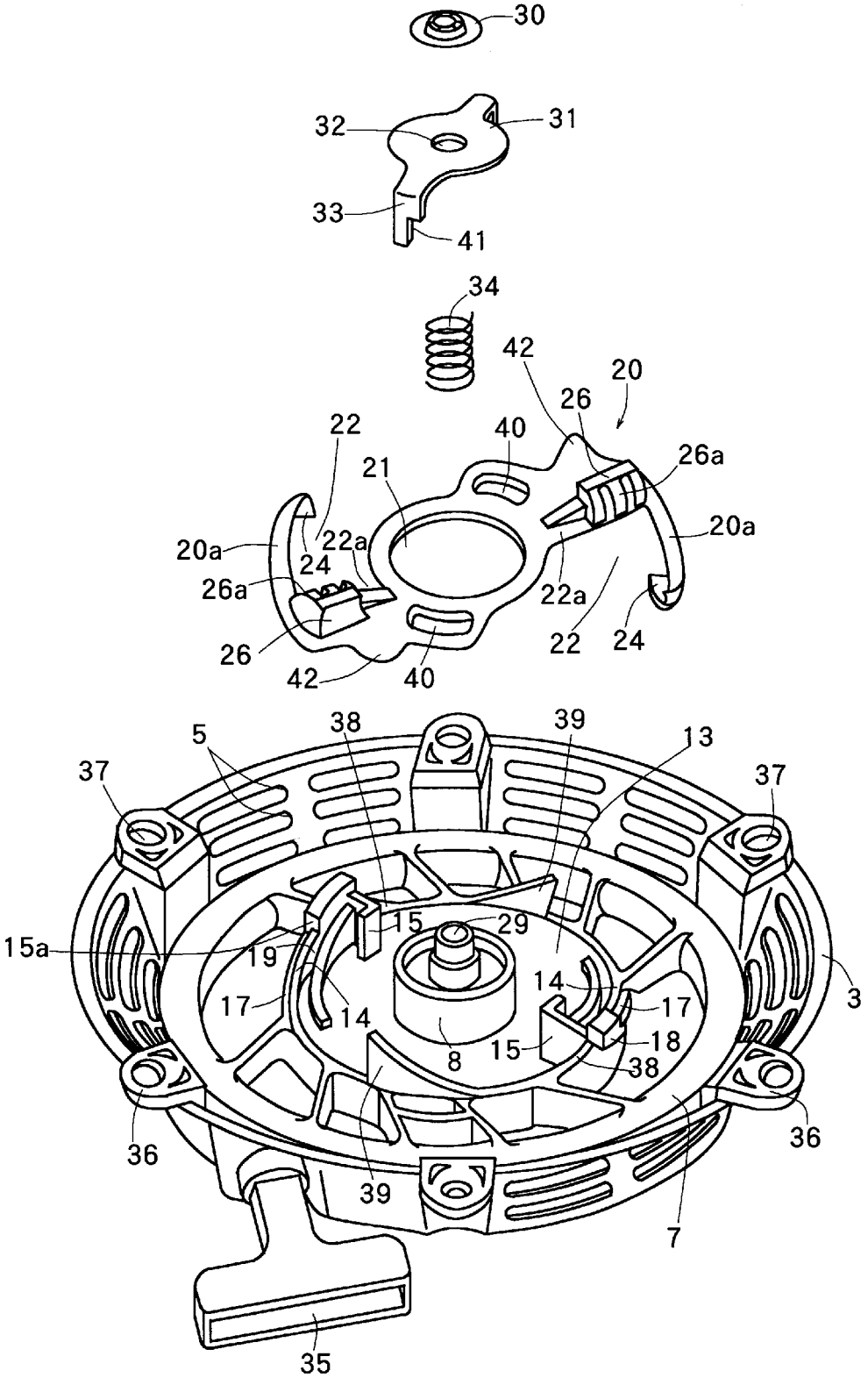
FIG. 16 is an exploded perspective view showing a main portion of the second embodiment of the present invention.
Figure 18:
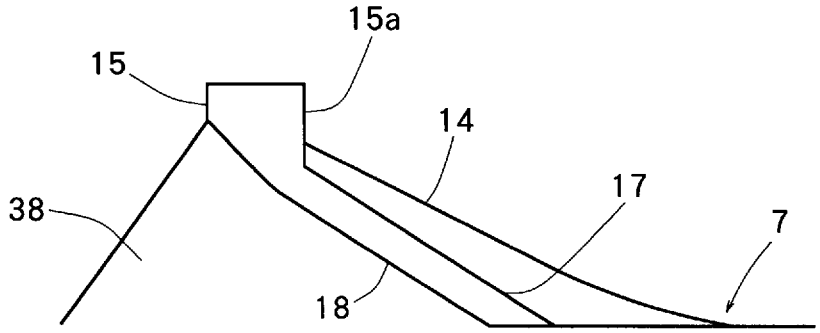
FIG. 18 is a side view showing a part of the reel of FIG. 17.
Figure 19:
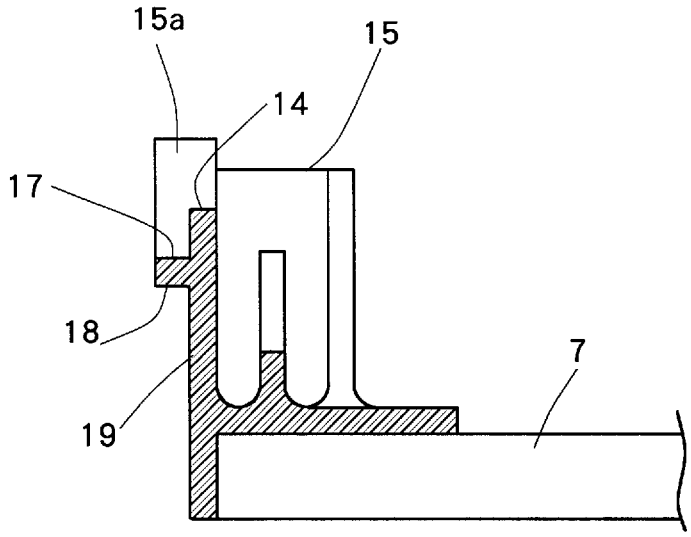
FIG. 19 is an enlarged sectional view taken on line XIX—XIX of FIG. 17.
Figure 20:
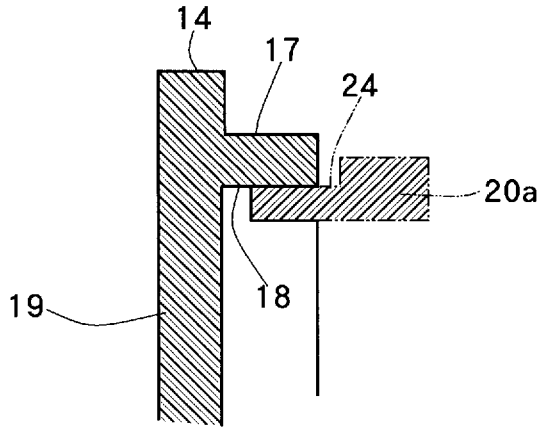
FIG. 20 is an enlarged sectional view taken on line XX—XX of FIG. 17.
Figure 21:
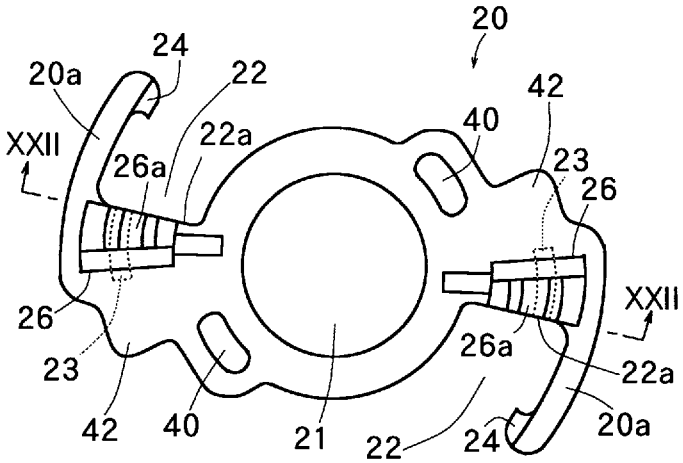
FIG. 21 is a plan view showing a dog which is applied to the second embodiment.
Figure 22:
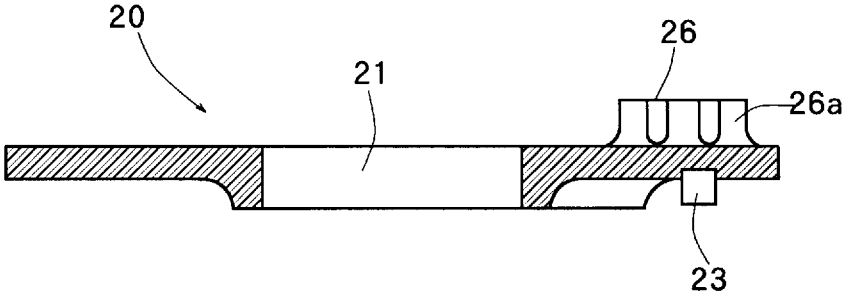
FIG. 22 is a sectional view taken on line XXII—XXII of FIG. 21.
Figure 25:
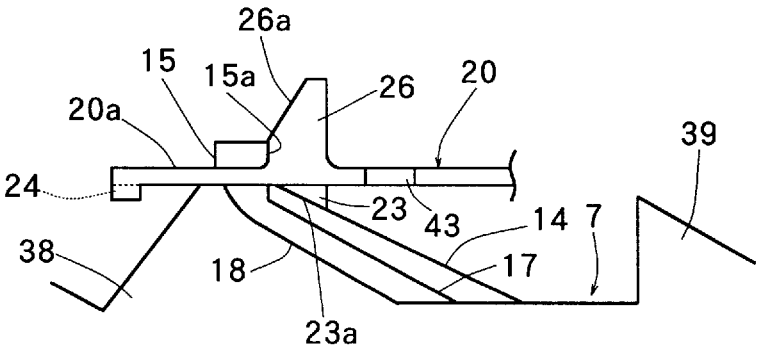
FIG. 25 is an explanatory view showing an operating state of the second embodiment, in which the reel is in its normally rotating state at a final stage of starting operation.

When the dog 20 is moved to the nearest location to the engine side and the engagement surface 15*a* is brought into abutment with the engaging edge 22*a*, the dog 20 stops movement. At the same time, the engagement claw 26 is brought into engagement with the engaging portion 28 to rotate the flywheel 27, so that the engine is actuated. This state is as shown in FIGS. 15 and 25.

At that time, the engagement claw 26 receives an impact when it is engaged with the engaging portion 28. The vertical component of force of this impact is received by the first cam 14 through the first cam follower 23 proximal to the engagement claw 26, i.e., right under the engagement claw 26 of FIG. 15.

Accordingly, the dog 20 can be supported in a stable manner and prevented from being deformed and/or damaged.

Furthermore, when the engine is actuated and the speed of rotation of the flywheel 27 becomes higher than that of the reel 7, the engaging portion 28 is engaged with the tapered surface 26*a*, and the dog 20 is urged to return to its original position by the engaging component of force acting on the surface 26*a*. As a consequence, the dog 20 is moved towards the reel 7 side and returned to its original position.

At that time, the second cam follower 24 is brought into engagement with the second cam 18 to facilitate the return of the dog 20 to its original position.

In this way, in the second embodiment, the dog 20 can be prevented from being deformed, and its positive operation and prolongation of its service life can be obtained.

Figure 26:
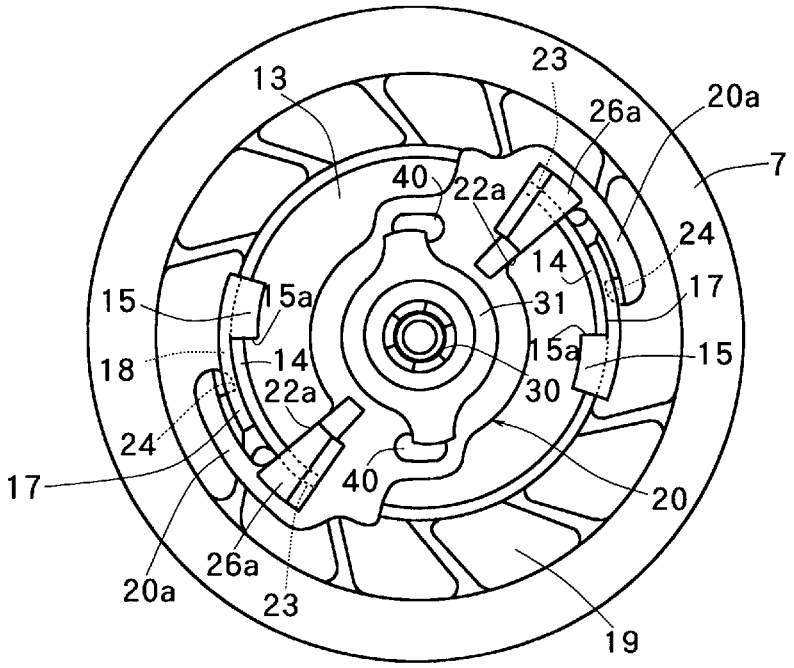
FIG. 26 is a plan view showing a third embodiment of the present invention, in which the dog is shown before starting operation.
Figure 27:
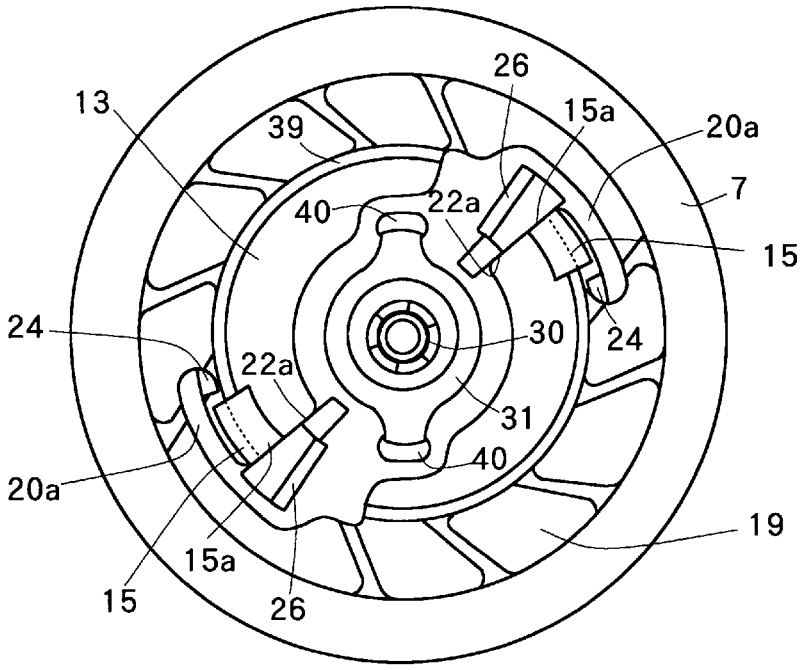
FIG. 27 is a plan view showing an operating state of the third embodiment in which the dog is in its projecting state at the time of starting operation.
Figure 28:
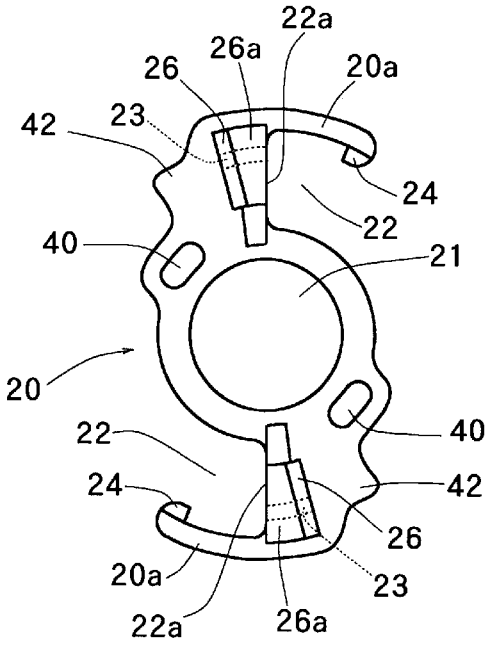
FIG. 28 is a plan view showing the dog which is applied to the third embodiment.

FIGS. 26 through 28 show a third embodiment of the present invention. This third embodiment is substantially the same as the second embodiment, but the first cam 14 of the first embodiment is eliminated to simplify the structure of the reel 7 so that the reel 7 can easily be produced.

Figure 29:
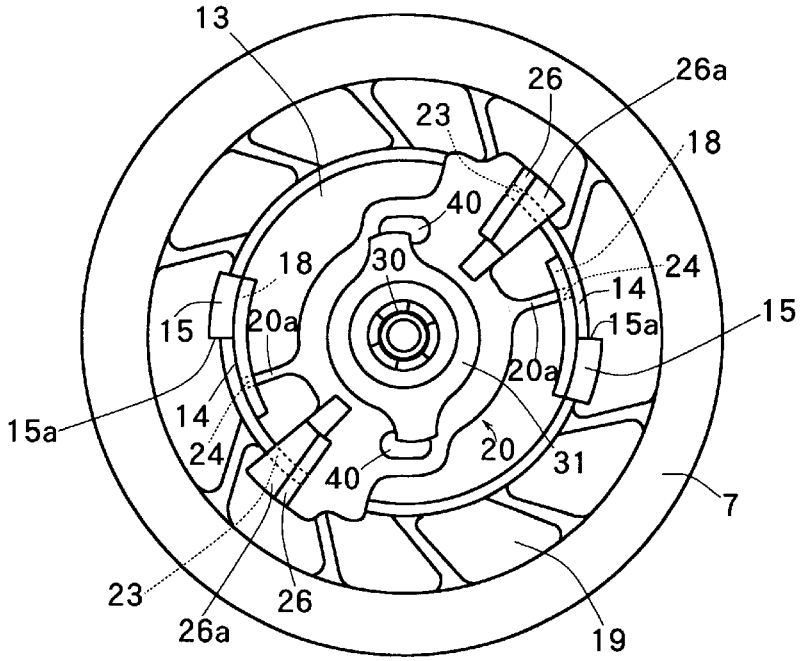
FIG. 29 is a plan view showing a fourth embodiment of the present invention in which the dog is shown before starting operation.
Figure 30:
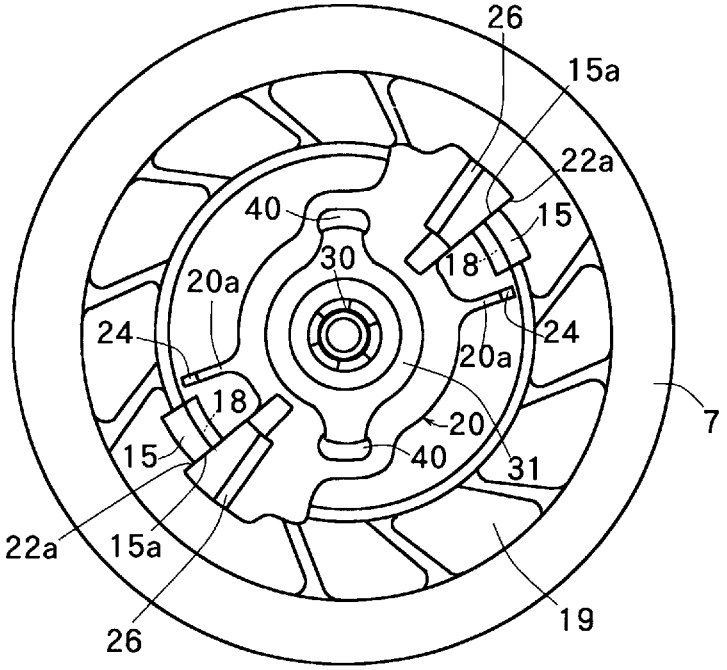
FIG. 30 is a plan view showing an operating state of the fourth embodiment in which the dog is in its projecting state at the time of starting operation.
Figure 31:
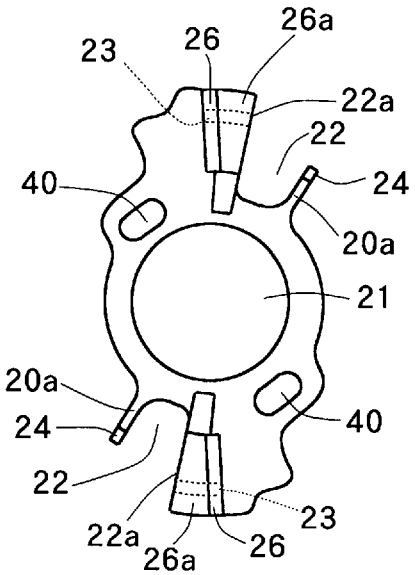
FIG. 31 is a plan view showing the dog which is applied to the fourth embodiment.

FIGS. 29 through 31 show a fourth embodiment of the present invention. In this fourth embodiment, the radial location of the first cam 14 is changed over to that of the second cam 18 and the first cam 14 is arranged adjacent to the second cam 18 in its radially outward direction. Corresponding to this arrangement, the radial location of the first cam follower 23 is changed over to that of the second cam follower 24 and the first cam follower 23 is arranged adjacent to the second cam follower 24 in its radially outward direction.

The dog arm 20*a* projects radially outwardly from the peripheral surface of the dog 20, and the length of its projection is reduced so as to correspond to the location of the second cam 18. Owing to this arrangement, the strength of the dog arm 20*a* can be increased, and the structure of the dog 20 can be simplified.

Figure 32:
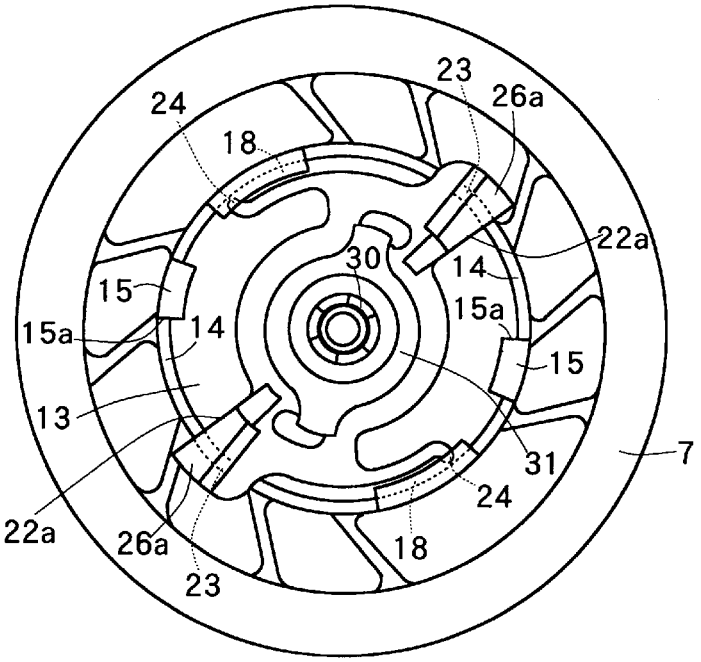
FIG. 32 is a plan view showing a fifth embodiment of the present invention in which the dog is shown before starting operation.
Figure 33:
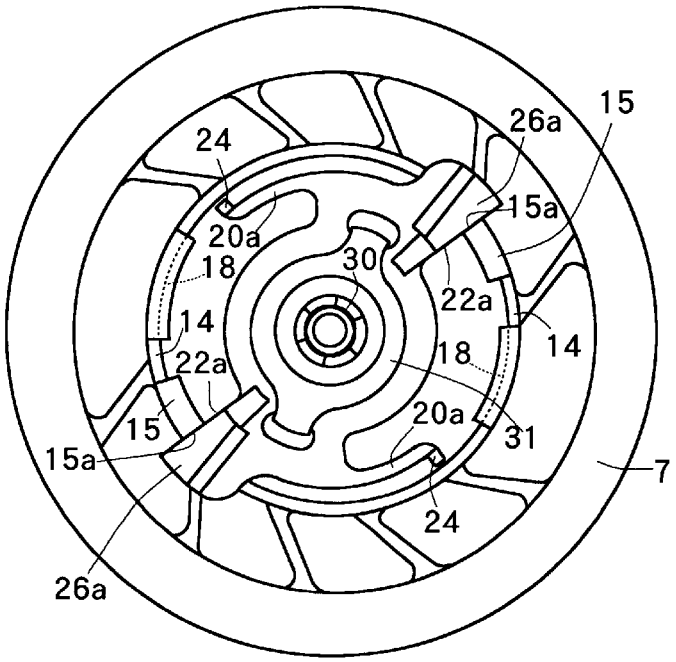
FIG. 33 is a plan view showing an operating state of the fifth embodiment in which the dog is in its projecting state at the time of starting operation.
Figure 34:
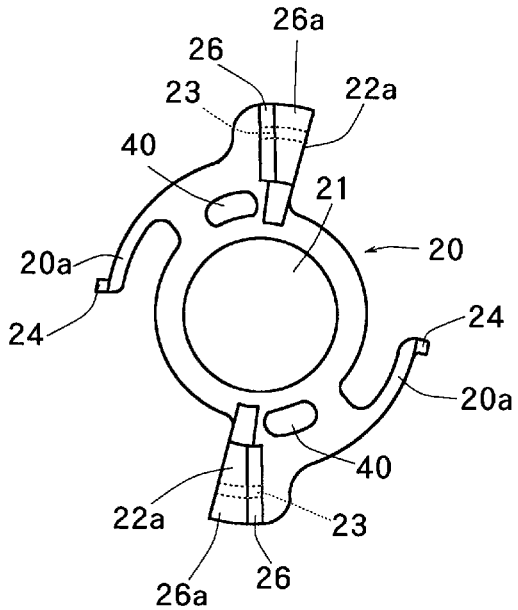
FIG. 34 is a plan view showing the dog which is applied to the fifth embodiment.

FIGS. 32 through 34 show a fifth embodiment of the present invention. In this fifth embodiment, as in the fourth embodiment, the first and second cams 14, 18 are arranged radially adjacent to the second cam followers 23, 24. The dog arm 20*a* projects in an arcuate pattern in the normally rotating direction of the reel 7 from the peripheral surface of the dog 20. The second cam follower 24 is disposed on the distal end portion of the dog arm 20*a*.

Instead of arranging the first and second cams 14 and 18 radially adjacent to the reel 7, the first and second cams 14 and 18 are spacedly arranged on a generally concentric circle of the outer periphery of the recess 13 with the projection 15 sandwiched therebetween, so that the structure of the reel 7 can be simplified and the reel 7 can easily be produced.

Figure 35:
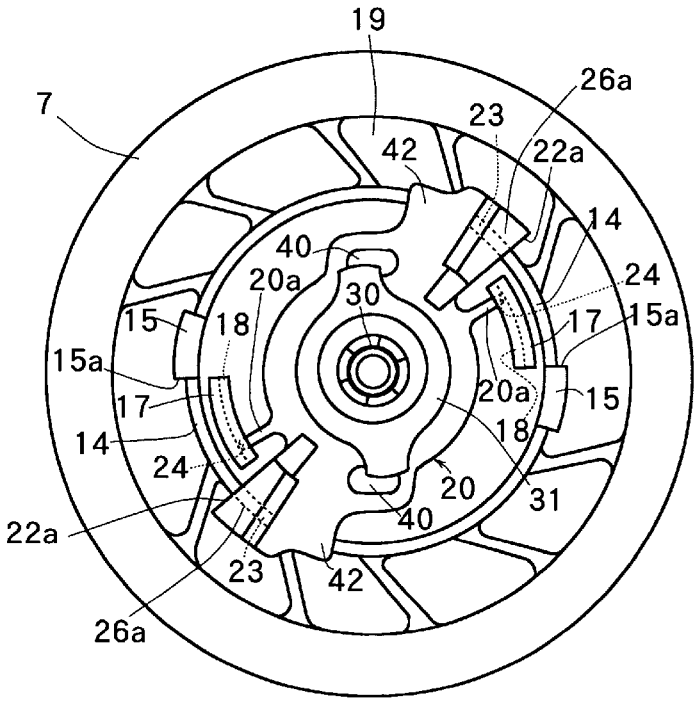
FIG. 35 is a plan view showing a sixth embodiment of the present invention in which the dog is shown before starting operation.
Figure 36:
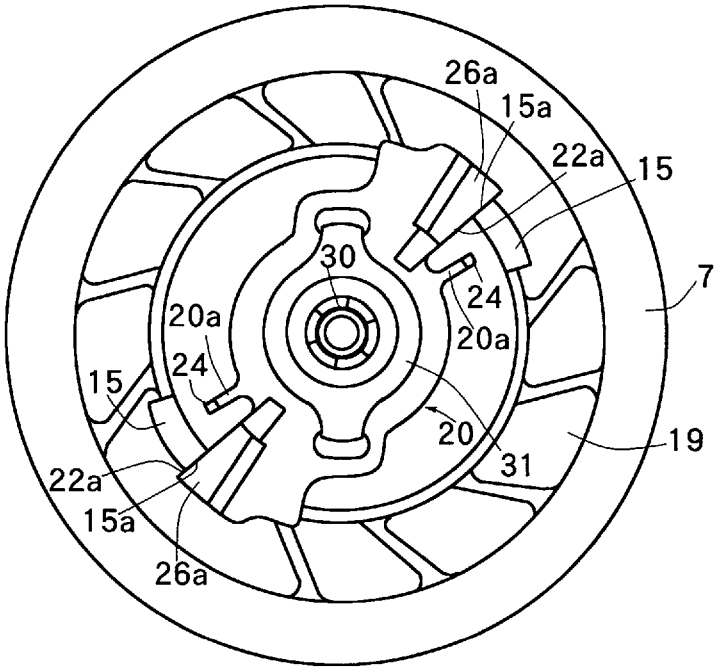
FIG. 36 is a plan view showing an operating state of the sixth embodiment, in which the dog is in its projecting state at the time of starting operation.
Figure 37:
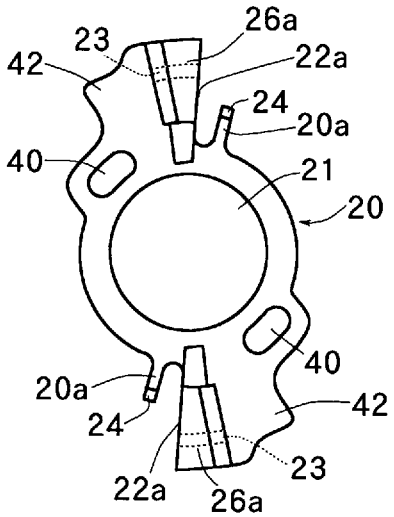
FIG. 37 is a plan view showing the dog which is applied to the sixth embodiment.

FIGS. 35 through 37 show a sixth embodiment of the present invention. In this sixth embodiment, as in the fourth embodiment, the first and second cams 14, 18, and the first and second cam followers 23, 24 are arranged radially, and the second cam 18 is separated from the first cam 14 and the projection 15 and arranged radially inwardly. That end portion of the cam 18 on the side of the engine is arranged at the same angle as that end portion of the first cam 14 on the side of the engine.

Furthermore, the length of the dog arm 20*a* projecting radially outwardly is reduced, so that the structure of the dog 20 is simplified, the movement of the dog 20 is stabilized and the strength of the dog arm 20*a* is improved.

Figure 38:
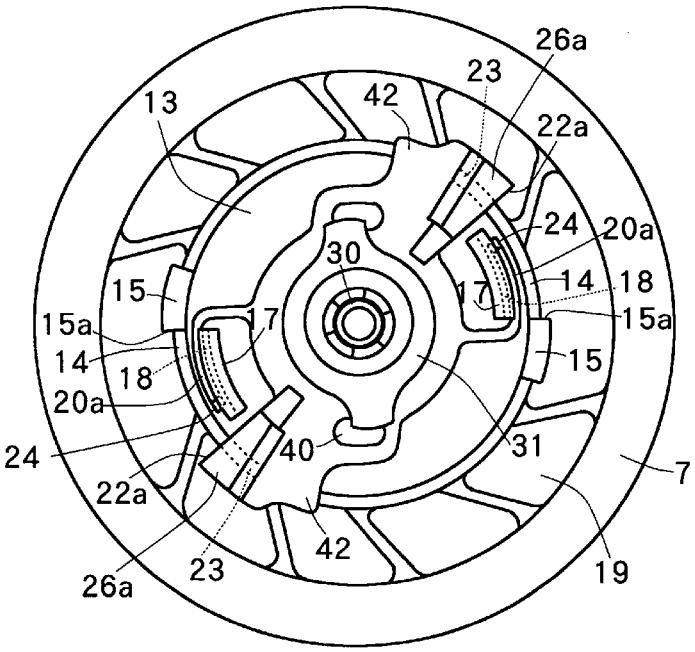
FIG. 38 is a plan view showing a seventh embodiment of the present invention in which the dog is shown before starting operation.
Figure 39:
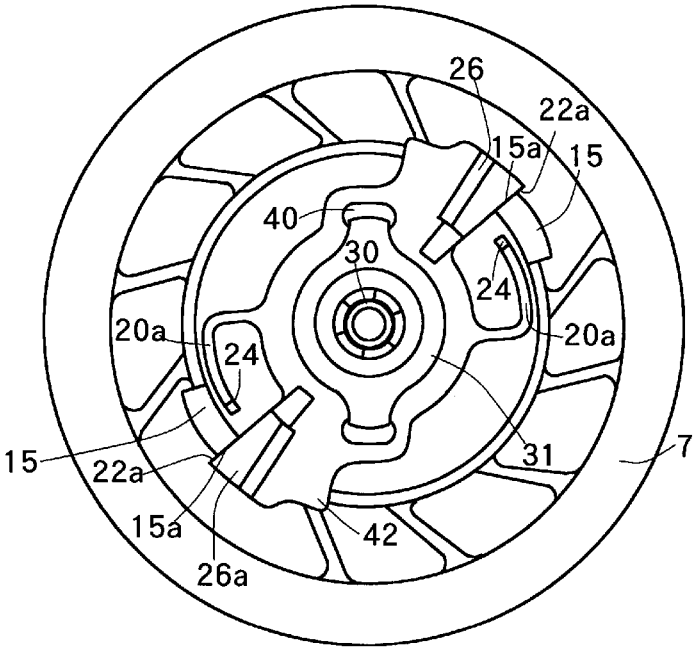
FIG. 39 is a plan view showing an operating state of the seventh embodiment, in which the dog is in its projecting state at the time of starting operation.
Figure 40:
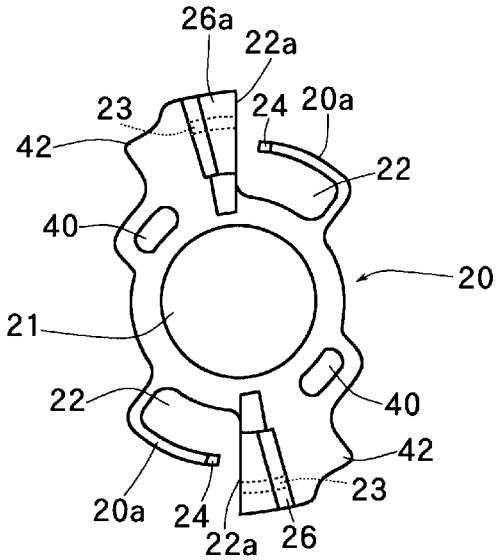
FIG. 40 is a plan view showing the dog which is applied to the seventh embodiment.

FIGS. 38 through 40 show a seventh embodiment of the present invention. In this seventh embodiment, as in the sixth embodiment, the first and second cams 14, 18 and the first and second cam followers 23, 24 are radially arranged and the second cam 18 is disposed on the outer peripheral side of the guide plate 17.

The dog arm 20*a* projects in an arcuate pattern in the normally rotating direction of the reel 7 from the outer periphery of the dog 20, and the second cam follower 24 disposed on the distal end of the dog arm 20*a* is arranged proximate to one end of the first cam follower 23, so that the movement of the dog 20 is stabilized.

Figure 41:
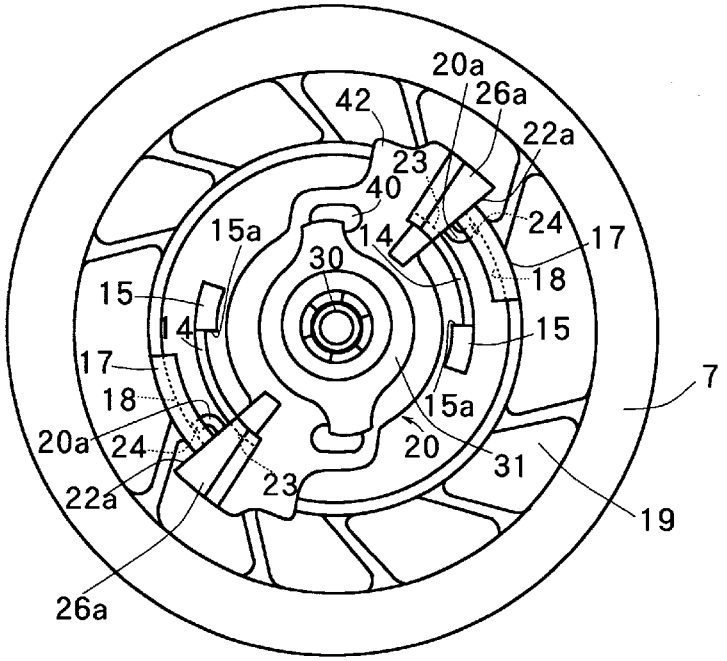
FIG. 41 is a plan view showing an eighth embodiment of the present invention, in which the dog is shown before starting operation.
Figure 42:
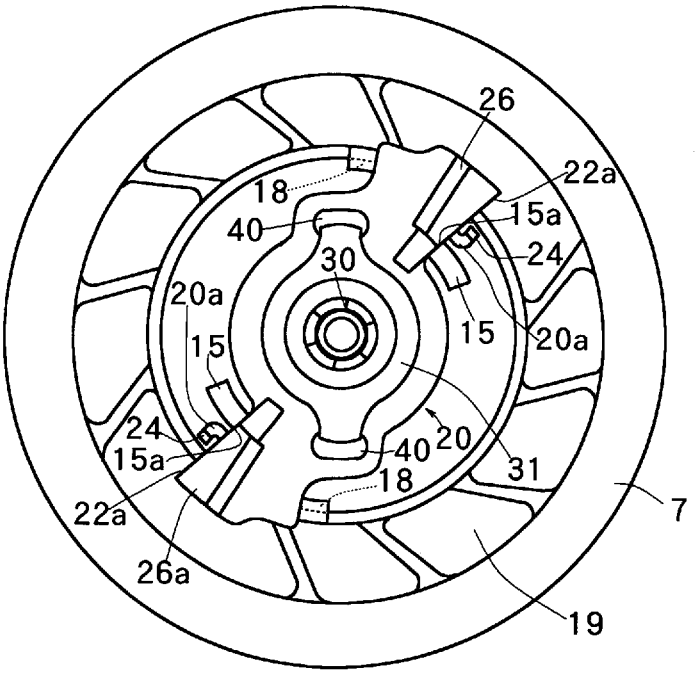
FIG. 42 is a plan view showing an operating state of the eighth embodiment, in which the dog is in its projecting state at the time of starting operation.
Figure 43:
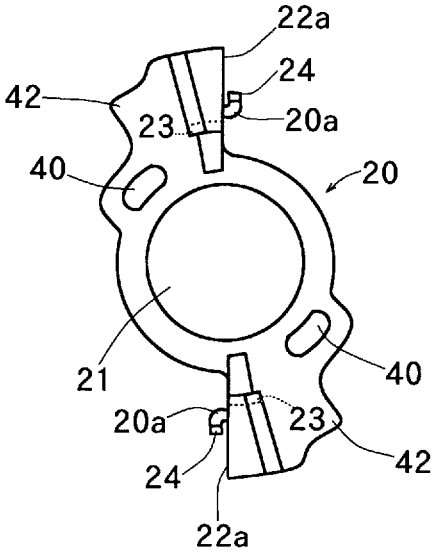
FIG. 43 is a plan view showing the dog which is applied to the eighth embodiment.

FIGS. 41 through 43 show an eighth embodiment of the present invention. In this eighth embodiment, the first cam 14 and the projection 15 are spacedly arranged radially inwardly of the second cam 18, and a short dog arm 20*a* projects from the engaging edge 22*a*, so that the structure of the dog 20 is simplified and the movement of the dog 20 is stabilized. In addition, the strength of the dog arm 20*a* is improved.

Figure 44:
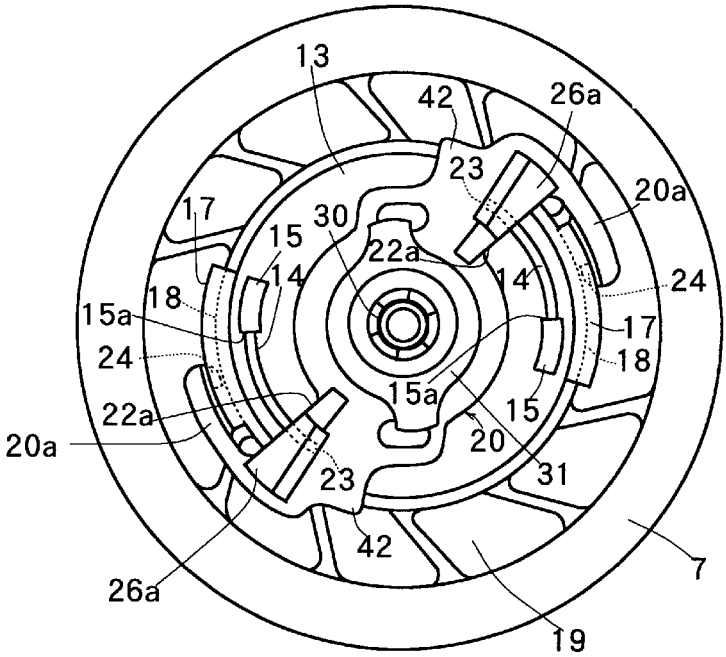
FIG. 44 is a plan view showing a ninth embodiment of the present invention in which the dog is shown before starting operation.
Figure 45:
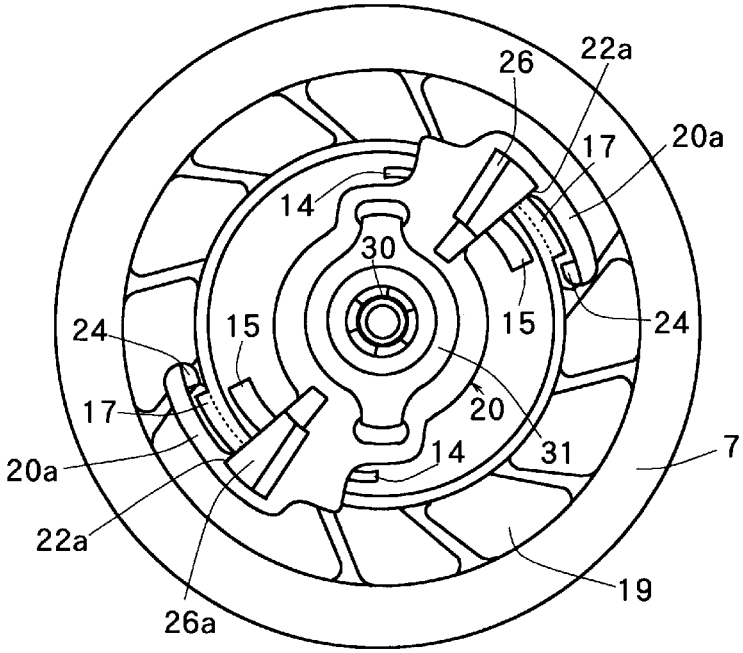
FIG. 45 is a plan view showing an operating state of the ninth embodiment, in which the dog is in its projecting state at the time of starting operation.
Figure 46:
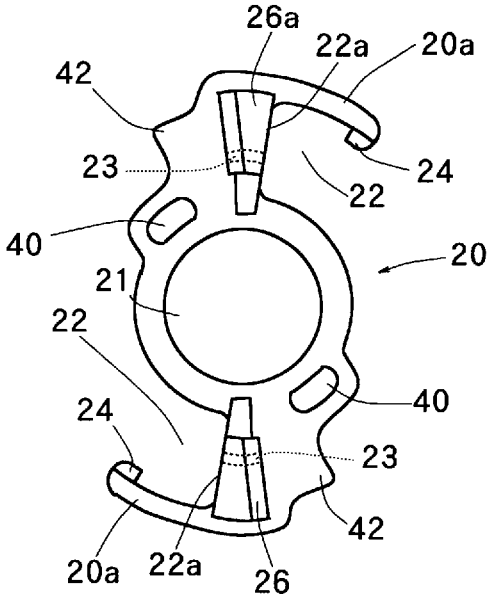
FIG. 46 is a plan view showing the dog which is applied to the ninth embodiment.

FIGS. 44 through 46 show a ninth embodiment of the present invention. In this ninth embodiment, the first cam 14 and the projection 15 are spacedly arranged radially inwardly of the second cam 18, so that the structure of the reel 7 is simplified and that end portion of the second cam 18 on the side of the engine is arranged at the same angle as that end face on the opposite side of the engagement surface 15*a* as in the first embodiment.

As described herein before, in the recoil starter according to the present invention, the reel is provided with a slant second cam facing the anti-engine side, and a second cam follower engageable with the second cam is disposed on the dog. Accordingly, in spite of long-time use even under critical circumstances, a smooth starting operation is ensured and the service life can be prevented from being reduced. In addition, since provision of the conventional retainer spring is no longer required, the number of component parts can be reduced and the manufacturing cost can be lowered.

Furthermore, according to the present invention, the engagement claw is provided proximate to the first cam follower. Accordingly, an impact, which would otherwise be received by the engagement claw at the time of starting operation, is received by the first cam through the first cam follower, so that the dog can be stabilized and prevented from being deformed and/or broken.

Moreover, according to the present invention, the engagement claw is provided on the dog side surface on the opposite side of the first cam follower and corresponding to the first cam follower. Accordingly, an impact, which would otherwise be received by the engagement claw at the time of starting operation, is received by the first cam through the first cam follower proximate to the engagement claw, so that a bending moment of the dog can be prevented from occurring and the stability of the dog can be improved. In addition, the dog can be prevented from being deformed and/or broken.

Furthermore, according to the present invention, the first cam follower projects toward the anti-engine side from the dog side surface. An impact, which would otherwise be received by the engagement claw, is positively received by the first cam through the first cam follower, so that dog can be stabilized. In addition, since the engaging friction with respect to the first cam can be reduced, a smooth operation of the dog can be ensured.

Moreover, according to the present invention, the engagement claw is disposed at a location proximate to the engaging edge of the dog engageable with the projection. Accordingly, when the engagement claw is engaged with the engaging portion on the engine side at the time of starting operation, the engagement claw can be supported in a stable manner through the projection and the dog can be held in a stable posture, so that the dog can be prevented from being deformed and/or broken.

Furthermore, according to the present invention, the second cam is located in the radial direction of the reel and on the internal or external side of the first cam. Accordingly, there can be obtained a second cam which can fulfill versatile requirements for the structure.

Moreover, according to the present invention, the second cam follower is located in the radial direction of the dog and on the internal or external side of the first cam follower. Accordingly, the second cam follower thus obtained can meet the versatile requirements for the structure of the second cam follower.

Furthermore, according to the present invention, the second cam is integral with the projection. Accordingly, the structure of those component parts can be simplified and they can be easily manufactured.

Moreover, according to the present invention, the second cam is spacedly located from the projection. Accordingly, versatile requirements for the structure of those component parts, as well as versatile requirements for the structures of the reel and dog, can be met.

Furthermore, according to the present invention, the second cam is located in the radial direction of the reel and on the internal or external side of the projection. Accordingly, there can be obtained a reel having a second cam which can fulfill versatile requirements for its structure. In addition, according to the present invention, the second cam is located in the circumferential direction of the reel and on the concentric circle with the projection. Accordingly, the structure of the reel can be simplified.

Moreover, according to the present invention, the dog arm projects from the peripheral surface of the dog and the second cam follower is disposed at the distal end portion of the arm. Accordingly, a smooth operation of the second cam follower can be obtained through the arm.

According to the present invention, there is a provision of the engagement projection capable of restricting relative rotation between the dog and the reel when the rope is loosened. Accordingly, when the rope is loosened, the dog can be prevented from axially abutting with the reel, and therefore the dog arm can be prevented from being broken.

What is claimed is:

1. A recoil starter, comprising:

(a) a reel rotatably supported by a case having an engine side, said reel having a center of rotation;

(b) a slant first cam projecting towards the engine side on one side of said reel concentric with the center of rotation of said reel;

(c) a dog rotatably and axially movably supported on an axis coaxial with the center of rotation of said reel;

(d) an engagement claw provided with said dog for engagement with an engagement portion on the engine side of said dog, and a first cam follower provided with said dog that is engageable with said first cam;

(e) a retainer mounted on the axis coaxial with the center of rotation of said reel, said retainer being engageable with said dog and capable of braking rotation of said dog;

(f) a projection projecting from said reel that is engageable with said dog when said reel starts rotation;

(g) a slant second cam located in a radial direction of and projecting from one side of said reel, on the inner or outer side of said first cam and concentric with the center of rotation of said reel, said slant second cam facing away from the engine side; and (h) a second cam follower provided with said dog engageable with said second cam.

2. A recoil starter, comprising:

(a) a reel rotatably supported by a case having an engine side, said reel having a center of rotation;

(b) a slant first cam on one side of said reel facing the engine side;

(c) a dog rotatably and axially movably supported on an axis coaxial with the center of rotation of said reel;

(d) an engagement claw provided with said dog for engagement with an engagement portion on the engine side of said dog, and a first cam follower provided with said dog that is engageable with said first cam;

(e) a retainer mounted on the axis coaxial with the center of rotation of said reel, said retainer being engageable with said dog and capable of braking rotation of said dog;

(f) a projection projecting from said reel that is engageable with said dog when said reel starts rotation;

(g) a slant second cam disposed on said reel away from the engine side; and (h) a second cam follower provided with said dog engageable with said second cam;

wherein said second cam follower is located in a radial direction of said dog and at an inner or outer side of said first cam follower.

3. A recoil starter, comprising:

(a) a reel rotatably supported by a case having an engine side, said reel having a center of rotation;

(b) a slant first cam on one side of said reel facing the engine side;

(c) a dog rotatably and axially movably supported on an axis coaxial with the center of rotation of said reel;

(d) an engagement claw provided with said dog for engagement with an engagement portion on the engine side of said dog, and a first cam follower provided with said dog that is engageable with said first cam;

(e) a retainer mounted on the axis coaxial with the center of rotation of said reel, said retainer being engageable with said dog and capable of braking rotation of said dog;

(f) a projection projecting from said reel that is engageable with said dog when said reel starts rotation;

(g) a slant second cam disposed on said reel away from the engine side; and (h) a second cam follower provided with said dog engageable with said second cam;

wherein said second cam is in a location spaced apart from said projection.

4. The recoil starter of claim 3, wherein said second cam is located in a radial direction of said reel and at an inner or outer side of said projection.

5. A recoil starter, comprising:

(a) a reel rotatably supported by a case having an engine side, said reel having a center of rotation;

(b) a slant first cam on one side of said reel facing the engine side;

(c) a dog rotatably and axially movably supported on an axis coaxial with the center of rotation of said reel;

(d) an engagement claw provided with said dog for engagement with an engagement portion on the engine side of said dog, and a first cam follower provided with said dog that is engageable with said first cam;

(e) a retainer mounted on the axis coaxial with the center of rotation of said reel, said retainer being engageable with said dog and capable of braking rotation of said dog;

(f) a projection projecting from said reel that is engageable with said dog when said reel starts rotation;

(g) a slant second cam disposed on said reel away from the engine side; and (h) a second cam follower provided with said dog engageable with said second cam;

wherein said dog comprises a dog arm projecting from a peripheral surface thereof, said dog arm being provided at a distal end portion thereof with said second cam follower.

* * * * *